US009734763B2

(12) United States Patent
Sun

(10) Patent No.: US 9,734,763 B2
(45) Date of Patent: Aug. 15, 2017

(54) PIXEL CIRCUIT, DRIVING METHOD AND DISPLAY APPARATUS

(71) Applicant: Boe Technology Group Co., Ltd., Beijing (CN)

(72) Inventor: Tuo Sun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 130 days.

(21) Appl. No.: 14/785,735

(22) PCT Filed: Mar. 30, 2015

(86) PCT No.: PCT/CN2015/075371
§ 371 (c)(1),
(2) Date: Oct. 20, 2015

(87) PCT Pub. No.: WO2016/074418
PCT Pub. Date: May 19, 2016

(65) Prior Publication Data

US 2017/0154576 A1 Jun. 1, 2017

(30) Foreign Application Priority Data

Nov. 11, 2014 (CN) ..... 2014 1 0643960

(51) Int. Cl.
*G09G 3/32* (2016.01)
*G09G 3/3258* (2016.01)
*G09G 3/20* (2006.01)

(52) U.S. Cl.
CPC ..... *G09G 3/3258* (2013.01); *G09G 3/2074* (2013.01); *G09G 2300/043* (2013.01);
(Continued)

(58) Field of Classification Search
CPC ..... G09G 3/30; G09G 3/3208; G09G 3/3233; G09G 2300/043; G09G 2300/0809;
(Continued)

(56) References Cited

U.S. PATENT DOCUMENTS 6,970,149 B2 * 11/2005 Chung ..... G09G 3/3233 315/169.3
8,384,626 B2 * 2/2013 Yamamoto ..... G09G 3/3233 345/76

(Continued)

FOREIGN PATENT DOCUMENTS

CN 1917019 A 2/2007
CN 104078004 A 10/2014

(Continued)

OTHER PUBLICATIONS

The International Search Report dated Jun. 17, 2015 for International Application No. PCT/CN2015/075371.

(Continued)

*Primary Examiner* — Gene W Lee
(74) *Attorney, Agent, or Firm* — Kinney & Lange, P.A.

(57) ABSTRACT

The embodiments of the present disclosure disclose a pixel circuit, a driving method and a display apparatus. The pixel circuit comprises multiple sub-pixel circuits, one of which is arranged with a threshold compensation module, and shares a voltage compensated by the threshold compensation module with other sub-pixel circuits. According to the embodiments of the present disclosure, only a threshold compensation module may be arranged for multiple pixels, so as to reduce an average area occupied by a single pixel and is beneficial for improving the PPI of the display apparatus.

20 Claims, 11 Drawing Sheets

(52) U.S. Cl.
CPC ..... *G09G 2300/0809* (2013.01); *G09G 2320/045* (2013.01)

(58) Field of Classification Search
CPC ... G09G 2300/0819; G09G 2320/0233; G09G 2320/043; G09G 2320/045
See application file for complete search history.

(56) References Cited

U.S. PATENT DOCUMENTS

| | | | | |
|---|---|---|---|---|
| 8,982,018 | B2 * | 3/2015 | Yamamoto | G09G 3/3233 315/294 |
| 9,196,197 | B2 * | 11/2015 | Kim | G09G 3/3258 |
| 9,640,109 | B2 * | 5/2017 | Yang | G09G 3/3225 |
| 2004/0051685 | A1 * | 3/2004 | Chung | G09G 3/3233 345/82 |
| 2005/0140604 | A1 | 6/2005 | Shin | |
| 2009/0219234 | A1 * | 9/2009 | Yamamoto | G09G 3/3233 345/80 |
| 2013/0127370 | A1 * | 5/2013 | Yamamoto | G09G 3/3233 315/294 |
| 2015/0116383 | A1 * | 4/2015 | Kim | G09G 3/3258 345/694 |
| 2015/0294625 | A1 * | 10/2015 | Lee | G09G 3/3233 345/691 |
| 2015/0364085 | A1 * | 12/2015 | Kanda | G09G 3/3233 345/214 |
| 2016/0155385 | A1 * | 6/2016 | Yang | G09G 3/3233 345/174 |
| 2016/0253963 | A1 * | 9/2016 | Yang | G09G 3/3225 345/211 |
| 2016/0335937 | A1 * | 11/2016 | Lee | G09G 3/2003 |

FOREIGN PATENT DOCUMENTS

| | | | |
|---|---|---|---|
| CN | 104091559 | A | 10/2014 |
| CN | 104134426 | A | 11/2014 |
| CN | 203931451 | U | 11/2014 |
| CN | 104318898 | A | 1/2015 |
| CN | 204117568 | U | 1/2015 |
| WO | 2004097782 | A1 | 11/2004 |

OTHER PUBLICATIONS

Second Chinese Office Action (including English translation) dated Mar. 31, 2016, for corresponding Chinese Application No. 201410643960.X.

* cited by examiner

PIXEL CIRCUIT, DRIVING METHOD AND DISPLAY APPARATUS

CROSS-REFERENCE TO RELATED APPLICATION(S)

This application is a Section 371 National Stage Application of International Application No. PCT/CN2015/075371, filed on 30 Mar. 2015, entitled "PIXEL CIRCUIT, DRIVING METHOD AND DISPLAY APPARATUS", which has not yet published, which claims priority to Chinese Application No. 201510239477.X, filed on 12 May 2015, incorporated herein by reference in their entirety.

TECHNICAL FIELD

The present disclosure relates to the field of display technology, and more particularly, to a pixel circuit, a driving method, and a display apparatus.

BACKGROUND

Organic light-emitting displays (OLED) are one of hotspots in the research field of flat panel display today. Compared with liquid crystal displays, OLEDs have advantages such as low energy consumption, a low production cost, self-illumination, a wide angle of view, a fast response speed or the like. Currently, in the display field of mobile phones, PDAs, digital cameras or the like, OLEDs have begun to replace traditional Liquid Crystal Display (LCD) screens. Design of a pixel driving circuit is the core technical content for OLEDs, and is of important research significance.

Compared with Thin Film Field Effect Transistor (TFT)-LCDs using a stable voltage to control brightness, OLEDs belong to current drive, and need stable current to control light emitting.

Due to process flows and aging of devices or the like, in the existing 2T1C driving circuit (comprising two thin film field effect transistors and one capacitor), threshold voltages of driving TFTs of various pixel points are non-uniform, which leads to a variation in current flowing through OLEDs of various pixels, and makes the display brightness non-uniform, thereby influencing the display effect of the whole image.

A solution for the above problem is to arrange a threshold voltage compensation loop in each pixel circuit to compensate for the threshold voltage of the driving TFT, so that a magnitude of the current flowing through the OLED is unrelated to the threshold voltage. However, if a voltage compensation loop is arranged in each pixel circuit, an area of a single pixel may increase, which results in reduction in a number of Pixels per Inch (PPI) of a corresponding display apparatus.

SUMMARY

The embodiments of the present disclosure provide a pixel circuit which can reduce an area of a single pixel.

According to an aspect of the present disclosure, a pixel circuit is provided, comprising:

a first sub-pixel circuit, comprising a driving transistor for generating driving current, a capacitor for pulling up a gate voltage of the driving transistor and a threshold compensation module, wherein the threshold compensation module is connected to the capacitor in the first sub-pixel circuit to compensate for a threshold voltage of the driving transistor in the first sub-pixel circuit for the capacitor;

at least one second sub-pixel circuit, comprising a driving transistor for generating driving current and a capacitor for pulling up a gate voltage of the corresponding driving transistor; and a compensation sharing circuit having a first end connected to the capacitor of the first sub-pixel circuit and a second end connected to the capacitor of the at least one second sub-pixel circuit, wherein the compensation sharing circuit is configured to turn on the first end and the second end under the control of an input control signal, so that the threshold compensation module compensates for a threshold voltage for the capacitor of the at least one second sub-pixel circuit while compensating for the threshold voltage for the capacitor of the first sub-pixel circuit.

Preferably, the compensation sharing circuit further comprises a sharing control transistor having one of a source and a drain connected to a first end of the capacitor in the first sub-pixel circuit, and the other connected to a first end of the capacitor in the at least one second sub-pixel circuit.

Preferably, each of the sub-pixel circuits further comprises a writing control transistor connected between a second end of a corresponding capacitor and a data voltage input end of a corresponding sub-pixel circuit.

Preferably, each of the sub-pixel circuits comprises at least one resetting control transistor connected to a capacitor of a corresponding sub-pixel circuit respectively to reset the capacitor of the corresponding sub-pixel circuit.

Preferably, a driving transistor of each sub-pixel circuit is a p-channel transistor, and each sub-pixel circuit further comprises a light-emitting control transistor connected between a drain of a corresponding driving transistor and an electroluminescent element;

the threshold compensation module comprises a compensation control transistor having one of a source and a drain connected to a drain of the driving transistor of the first sub-pixel circuit, and the other connected to the first end of the capacitor in the first sub-pixel circuit; and a gate of the driving transistor in the first sub-pixel circuit is connected to the first end of the capacitor in the first sub-pixel circuit, a gate of the driving transistor in the at least one second sub-pixel circuit is connected to a second end of the capacitor in the at least one second sub-pixel circuit, and the drain of the at least one resetting control transistor is connected to a first end of a corresponding capacitor.

Preferably, a gate of the writing control transistor in the first sub-pixel circuit is connected to a first control signal input end of the pixel circuit; gates of the writing control transistor and the resetting control transistor in the at least one second sub-pixel circuit are connected to a second control signal input end; gates of the compensation control transistor and the sharing control transistor are connected to a third control signal input end of the pixel circuit; gates of various light-emitting control transistors are connected to a fourth control signal input end; and various transistors of which gates are connected to the same input end have the same channel type.

Preferably, the first sub-pixel circuit further comprises a jumping control transistor connected between the source of the driving transistor and the second end of the capacitor and has a gate connected to the third control signal input end; and the first control signal input end and the third control signal input end are the same input end.

Preferably, a driving transistor in each sub-pixel circuit is a P-channel transistor having a gate connected to a first end of a corresponding capacitor; and each sub-pixel circuit further comprises a light-emitting control transistor connected between a drain of the driving transistor and an electroluminescent element, the threshold compensation module comprises a compensation control transistor having one of a source and a drain connected to the drain of the driving transistor in the first sub-pixel circuit and the other connected to the first end of the capacitor in the first sub-pixel circuit.

Preferably, a driving transistor in each sub-pixel circuit is an N-channel transistor, and has a gate connected to a first end of a capacitor of a corresponding sub-pixel circuit; each sub-pixel circuit further comprises a light-emitting control transistor connected between a drain of a corresponding driving transistor and an electroluminescent element; the threshold compensation module comprises a compensation control transistor having one of a source and a drain connected to the source of the driving transistor in the first sub-pixel circuit and the other connected to the ground; and the first sub-pixel circuit further comprises a charging control transistor having one of a source and a drain connected to the first end of the capacitor in the first sub-pixel circuit.

Preferably, the other of the source and drain of the charging control transistor is connected to a working voltage input end of the pixel circuit.

According to another aspect of the present disclosure, a method for driving the pixel circuit described in any of the above embodiments is further provided, comprising:

applying a control signal to turn on a first end and a second end of the compensation sharing circuit when the first sub-pixel circuit implements pixel compensation.

According to another aspect of the present disclosure, a display apparatus is further provided, comprising the pixel circuit described in any of the above embodiments.

DETAILED DESCRIPTION

Detailed description of the present disclosure will be further described below in conjunction with accompanying drawings and embodiments. The following embodiments are merely used to illustrate the technical solutions of the present disclosure more clearly, instead of limiting the protection scope of the present disclosure.

The pixel circuit according to the present disclosure comprises multiple sub-pixel circuits for driving multiple pixels to emit light for display. In the present disclosure, a threshold compensation module for threshold compensation is arranged in one of the sub-pixel circuits, and a voltage compensated by the threshold compensation module is shared by other sub-pixel circuits since threshold voltages of driving transistors in adjacent sub-pixel circuits are generally close to each other. Therefore, according to the embodiments of the present disclosure, threshold compensation can be effectively completed without arranging a threshold compensation module in other sub-pixel circuits. In a high PPI product, as pixel circuits corresponding to various pixels are close to each other, the pixel circuit according to the embodiments of the present disclosure is particularly suitable for the high PPI product. The structure, principle and driving method of the pixel circuit according to the embodiments of the present disclosure will be described below in conjunction with some specific circuits.

First Embodiment

Figure 1:
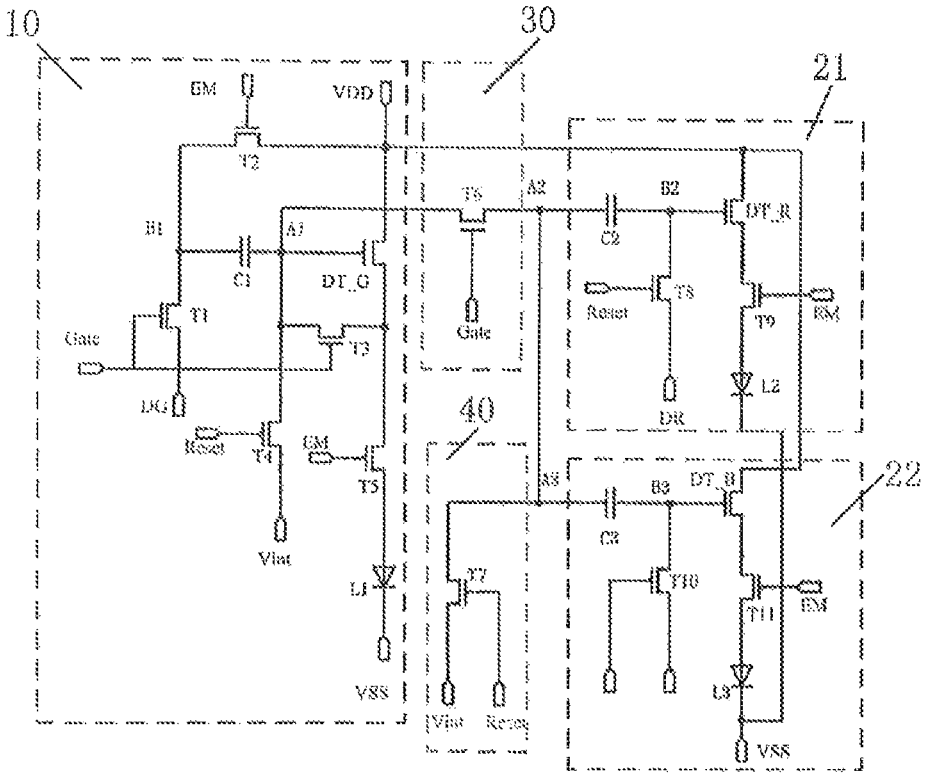
FIG. 1 illustrates a structural diagram of a pixel circuit according to a first embodiment of the present disclosure.

The first embodiment of the present disclosure provides a pixel circuit. As shown in FIG. 1, the pixel circuit comprises a first sub-pixel circuit 10, two second sub-pixel circuits 21 and 22, a compensation sharing circuit 30, and a sharing control circuit 40. The first sub-pixel circuit 10 comprises a first switch transistor T1, a second switch transistor T2, a third switch transistor T3, a fourth switch transistor T4, a fifth switch transistor T5, a first driving transistor DT_G, a first capacitor C1, and a first electroluminescent element L1. The second sub-pixel circuit 21 comprises an eighth switch transistor T8, a ninth switch transistor T9, a second driving transistor DT_R, a second capacitor C2 and a second electroluminescent element L2. The other second sub-pixel circuit 22 comprises a tenth switch transistor T10, an eleventh switch transistor T11, a third driving transistor DT_B, a third capacitor C3, and a third electroluminescent element L3. The compensation sharing circuit 30 comprises a sixth switch transistor T6. The sharing control circuit 40 comprises a seventh switch transistor T7. The above various transistors may be P-channel transistors.

In the first sub-pixel circuit 10, drains of the first switch transistor T1 and the second switch transistor T2 are connected to an end B1 of the first capacitor C1, a source of the second switch transistor T2 is connected to a source of the first driving transistor DT_G, drains of the third switch transistor T3 and the fourth switch transistor T4 and a gate of the first driving transistor DT_G are connected to an end A1 of the first capacitor C1, a source of the third switch transistor T3 is connected to a drain of the first driving transistor DT_G, and the fifth switch transistor T5 has a source connected to the drain of the first driving transistor DT_G and a drain connected to an anode of the first electroluminescent element L1.

In the second sub-pixel circuit 21, a drain of the eighth switch transistor T8 and a gate of the second driving transistor DT_R are connected to an end B2 of the second capacitor C2, and the ninth switch transistor T9 has a source connected to a drain of the second driving transistor DT_R and a drain connected to an anode of the second electroluminescent element L2.

In the other second sub-pixel circuit 22, a drain of the tenth switch transistor T10 and a gate of the third driving transistor DT_B are connected to an end B3 of the third capacitor C3, and the eleventh switch transistor T11 has a source connected to a drain of the third driving transistor DT_B and a drain connected to an anode of the third electroluminescent element L3.

The end A1 of the first capacitor C1 is further connected to an end A2 of the second capacitor C2 and an end A3 of the third capacitor C3 through the sixth switch transistor T6, and a drain of the seventh switch transistor T7 is connected to the end A2 of the second capacitor C2 and the end A3 of the third capacitor C3.

Further, the pixel circuit has the following signal input ends: a working voltage input end VDD, three data voltage input ends DG, DR, and DR, a ground end VSS, a reset voltage input end Vint, and three control signal input ends EM, Gate, and Reset. Sources of the first driving transistor DT_G, the second driving transistor DT_R, and the third driving transistor DT_B are connected to the working voltage output end VDD, the cathodes of the first electroluminescent element L1, the second electroluminescent element L2 and the third electroluminescent element L3 are connected to the ground end VSS. Gates of the first switch transistor T1, the third switch transistor T3 and the sixth switch transistor T6 are connected to the first signal input end Gate, Gates of the second switch transistor T2, the fifth switch transistor T5, the ninth switch transistor T9 and the eleventh switch transistor T11 are connected to the second signal input end EM. Gates of the fourth switch transistor T4, the seventh switch transistor T7, the eighth switch transistor T8 and the tenth switch transistor T10 are connected to the third signal input end Reset. A source of the first switch transistor T1 is connected to DG, the source of the second switch transistor T2 is connected to DR, the source of the third switch transistor T3 is connected to DB, and sources of the fourth switch transistor T4 and the seventh switch transistor T7 are connected to the reset voltage input end Vint.

Figure 2:
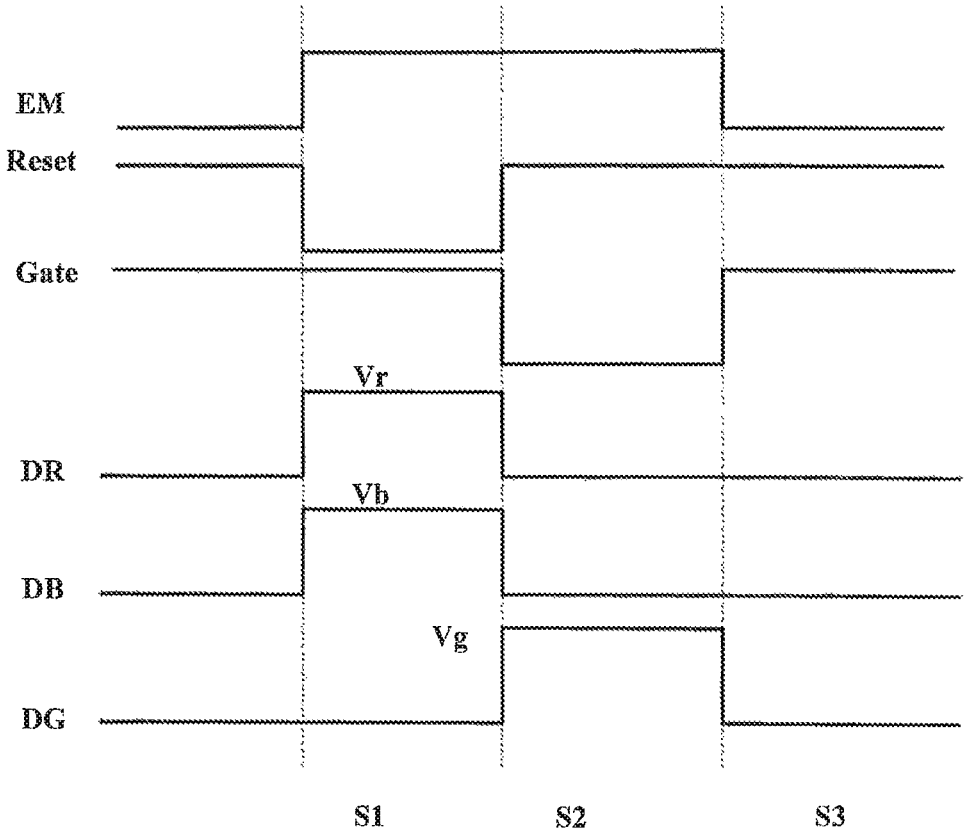
FIG. 2 illustrates a timing diagram of signals in a driving method for driving the pixel circuit illustrated in FIG. 1.
Figure 3A:
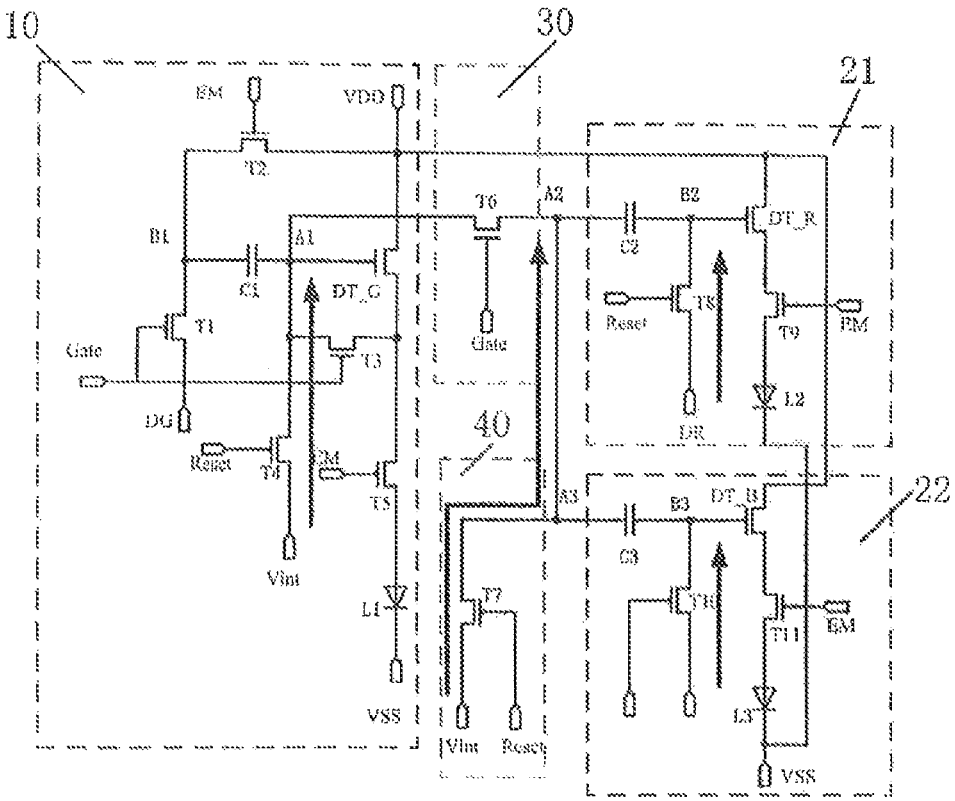
FIGS. 3*a*-3*c* illustrates diagrams of flow directions of current of the pixel circuit in FIG. 1 in different timing sequences in the driving method illustrated in FIG. 2.
Figure 3B:
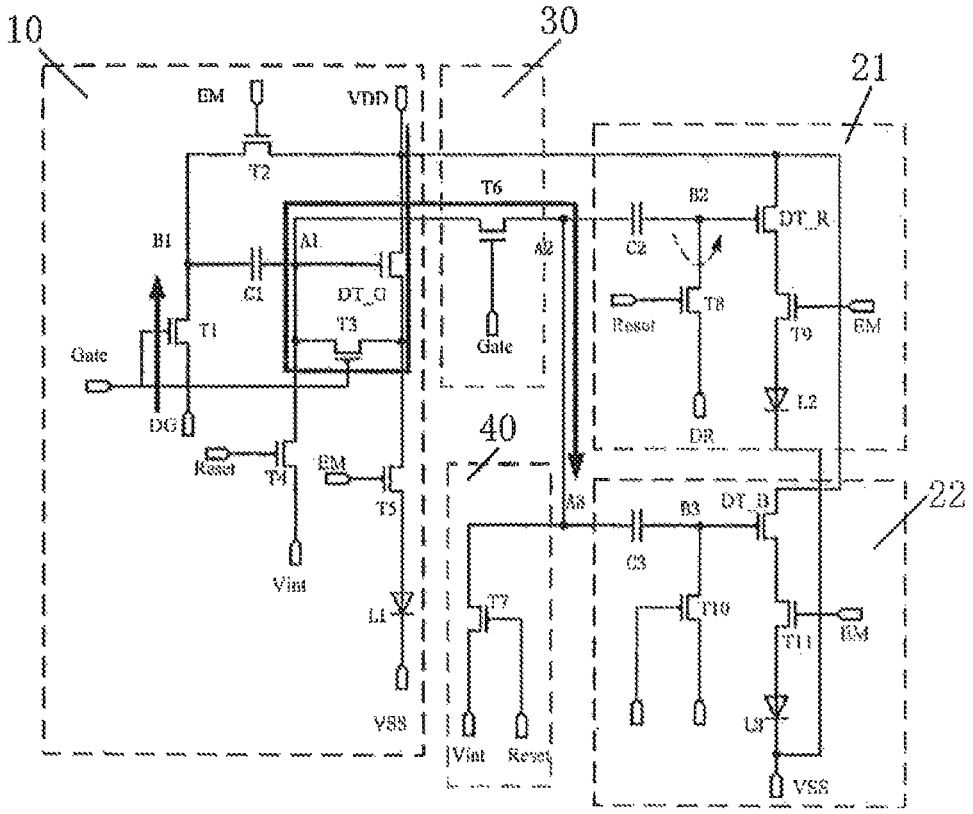
Figure 3C:
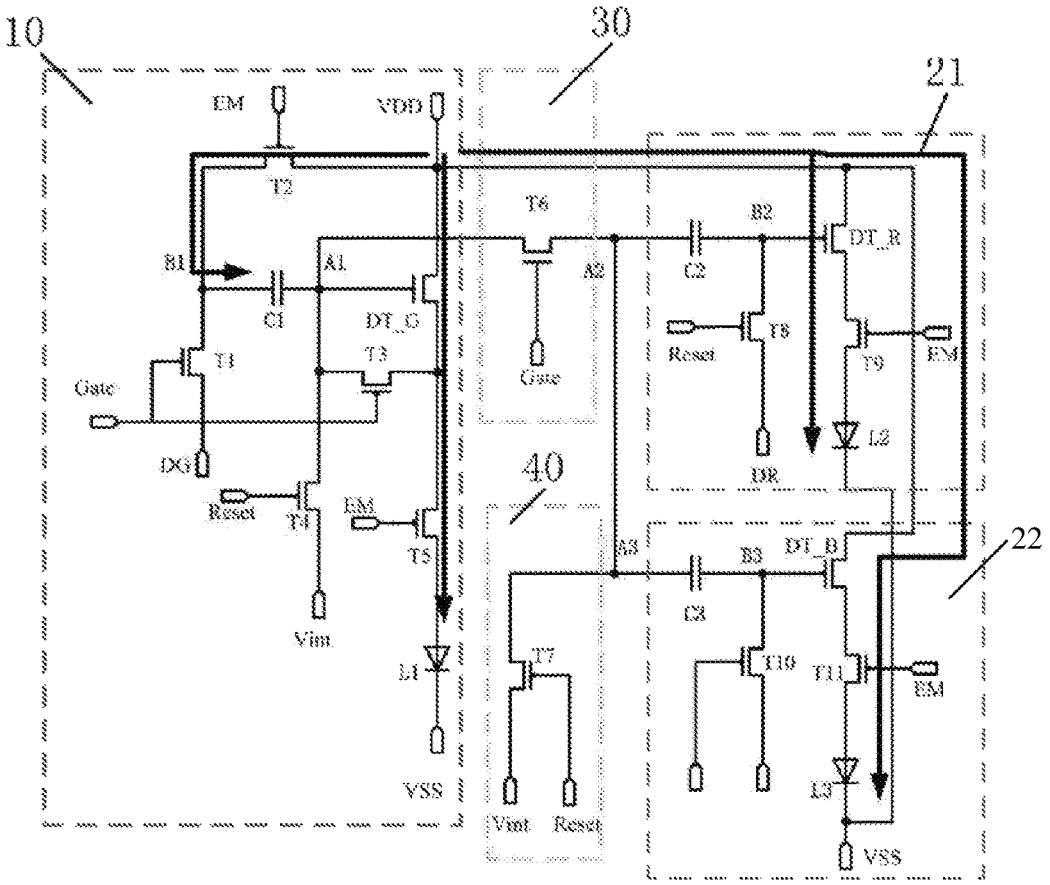

There are many driving methods for the pixel circuit illustrated in FIG. 1. An example driving method will be described below in conjunction with FIGS. 2 and 3*a*-3*c*, and the principle of achieving pixel driving by the pixel circuit in FIG. 1 will be described. FIG. 2 is a timing diagram of signals in the driving method, and FIGS. 3*a*-3*c* are diagrams of flow directions of current and voltages at key points in the pixel circuit in different phases of the method. As voltages applied to the end Vint and the end VDD are generally fixed in practical applications, for convenience of illustration, the voltage at the end Vint is represented by Vint, and the voltage at the end VDD is represented by VDD.

As shown in FIG. 2, in a first phase S1, a low level signal is applied to Reset, high voltages are applied to Gate and EM, a data voltage Vr corresponding to the second sub-pixel circuit 21 is applied to the end DR, and a data voltage Vb corresponding to the second sub-pixel circuit 22 is applied to the end DB. In this case, as shown in FIG. 3*a*, in the first phase S1, the fourth switch transistor T4, the seventh switch transistor T7, the eighth switch transistor T8 and the tenth switch transistor T10 are turned on, and other control transistors are turned off. Voltages at the end A1 of the first capacitor C1 the end A2 of the second capacitor C2 and the end A3 of the third capacitor A3 are set to the voltage Vint, a voltage at the end B2 of the second capacitor C2 is set to Vr, and a voltage at the end B3 of the third capacitor C3 is set to Vb. With respect to the second capacitor C2, a voltage difference between the end B2 and the end A2 is $V_{B2A2}$=Vr−Vint. With respect to the third capacitor C3, a voltage difference between the end B3 and the end A3 is $V_{B3A3}$=Vb−Vint. This phase corresponds to resetting voltages at the ends A (A1, A2 and A3) of various capacitors, and the fourth switch transistor T4 and the seventh switch transistor T7 are equivalent to resetting control transistors. The eighth switch transistor T8 and the tenth switch transistor T10 are used to write the data voltages to the end B2 and the end B3, and are equivalent to writing control transistors.

In a second phase S2, a low level signal is applied to Gate, high levels are applied to Reset and EM, and a data voltage Vg corresponding to the second sub-pixel circuit 22 is applied to the end DG. In this case, as shown in FIG. 3*b*, in the second phase S2, the first switch transistor T1, the third switch transistor T3, and the sixth switch transistor T6 are turned on, and other control transistors are turned off. At this time, the VDD charges the end A1 of the first capacitor C1 through the first driving transistor DT_G and the third switch transistor T3, until the voltage at this end reaches VDD+Vth1 (wherein Vth1 is a turn-on threshold voltage of the first driving transistor DT_G, which is a negative value). As the first switch transistor T1 is turned on, the voltage at the end B1 of the first capacitor C1 is set to Vg. In this case, the sixth switch transistor T6 is also turned on, and the voltages at the end A2 of the second capacitor C2 and the end A3 of the third capacitor C3 are set to VDD+Vth1. An equal voltage jump phenomenon occurs at the end B2 of the second capacitor C2, and the voltage changes to Vr+VDD+Vth1−Vint (a voltage difference between both ends is maintained to Vr−Vint). Correspondingly, An equal voltage jump phenomenon occurs at the end B3 of the third capacitor C3, and the voltage changes to Vb+VDD+Vth1−Vint. In this phase, the A1 end of the first capacitor C1 is charged for the first time through the third switch transistor T3, to compensate for the voltage at the end A1 to reach a voltage related to the threshold voltage of the first driving transistor DT_G. Therefore, the third switch transistor T3 is equivalent to a compensation control transistor. Further, the end A2 of the second capacitor C2 and the end A3 of the third capacitor C3 share the compensation voltage for the end A1 of the first capacitor C1 through the sixth switch transistor T6, and therefore, the sixth switch transistor T6 is equivalent to a sharing control transistor. The first switch transistor T1 is used to write a data voltage to the end B1, and is equivalent to a writing control transistor.

In a third phase S3, a low level signal is applied to EM, and high level signals are applied to Gate and Reset. In this case, the second switch transistor T2, the fifth switch transistor T5, the ninth switch transistor T9 and the eleventh switch transistor T11 controlled by EM are turned on, and other control transistors are turned off. At this time, as shown in FIG. 3*c*, the voltage at the end B1 of the first capacitor C1 is set to VDD, and correspondingly, the voltage at the end A1 of the first capacitor C1 jumps to 2VDD+Vth1−Vg. The second switch transistor T2 acts as a jumping control transistor in the first sub-pixel circuit 10. As the fifth switch transistor T5, the ninth switch transistor T9, and the eleventh switch transistor T11 are turned on, the first electroluminescent element L1, the second electroluminescent element L2 and the third electroluminescent element L3 start to emit light, and the fifth switch transistor T5, the ninth switch transistor T9 and the eleventh switch transistor T11 act as light-emitting control transistors.

Current in the first electroluminescent element L1 is $I1=C(VGS-Vth1)^2$ $$=C(2VDD+Vth1-VDD-Vg-Vth1)^2$$

$$=C(VDD-Vg)^2$$

Current in the second electroluminescent element L2 is $I2=C(VGS-Vth2)^2$ $$=C(VDD+Vth1+Vr-Vint-VDD-Vth2)^2$$

$$=C(Vr-Vg+Vth1-Vth2)^2$$

As threshold voltages of driving transistors in adjacent pixel circuits are generally equivalent in practical applications, Vth1, Vth2, and Vth3 may be considered as being equal. That is, $I2=C(Vr-Vg)^2$, and correspondingly, current in the third electroluminescent element L3 is $I3=C(Vb-Vg)^2$, wherein C is a current coefficient of a corresponding driving transistor.

Thus, current flowing through various electroluminescent elements are finally unrelated to the threshold voltages of the corresponding driving transistors so as to prevent a drift in the threshold due to aging of the driving transistors from influencing light-emitting of various pixels for display.

In the first embodiment of the present disclosure, a compensation control transistor (the third switch transistor T3) for compensation and a corresponding jumping control transistor (the second switch transistor T2) are only arranged in the first sub-pixel circuit 10. Corresponding compensation module and jumping control transistor are not arranged in the second sub-pixel circuit, and the compensation voltage for the first sub-pixel circuit may be transferred to two sub-pixel circuits 21 and 22 merely through the sharing control transistor, i.e., the sixth switch transistor T6, so as to achieve threshold compensation for the corresponding driving transistors. Further, the second sub-pixel circuits 21 and 22 share the resetting control transistor, i.e., the seventh switch transistor T7, so as to further reduce a number of transistors. In the first embodiment of the present disclosure, only 14 transistors are used, which largely reduces the number of transistors for use as compared with the manner in the related art of arranging a corresponding threshold compensation module for each pixel (at least 18 transistors are needed).

Of course, in a specific implementation, a resetting control transistor may also be arranged for each pixel circuit.

It should be noted that although a number of second sub-pixel circuits in the first embodiment of the present disclosure is 2, in the specific implementation, the number of the second sub-pixel circuits is not limited thereto. If a distance between pixels is small enough, the number of the second sub-pixel circuits here may be large enough. Of course, in practical applications, it may also be the case that only a second sub-pixel circuit is arranged.

It should be noted that although FIG. 1 is described by taking various transistors being P-channel transistors as an example, in practical applications, on the premise that a connection structure is maintained to be unchanged, the various transistors in FIG. 1 except for the driving transistors may also be N-channel transistors. In the driving process, signals which are completely opposite to the control signals in FIG. 2 may also be applied to achieve the same effect. Preferably, as it needs to turn on and turn off various transistors of which gates are connected to the same input end at the same time, these transistors may be set to have the same channel type. The purpose of the preferable embodiment of the present disclosure is to ensure consistent manufacturing process of the circuits, and reduce the manufacturing difficulty, and should not be construed as limiting the protection scope of the present disclosure.

Second Embodiment

Figure 4:
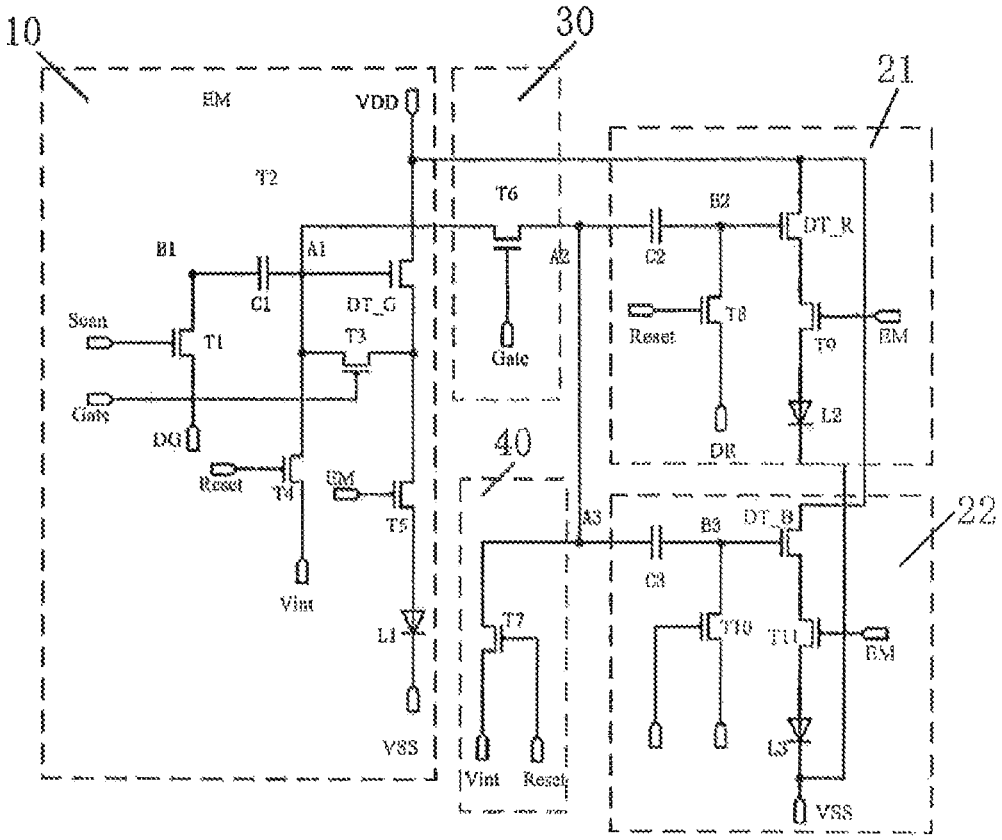
FIG. 4 illustrates a structural diagram of a pixel circuit according to a second embodiment of the present disclosure.
Figure 5:
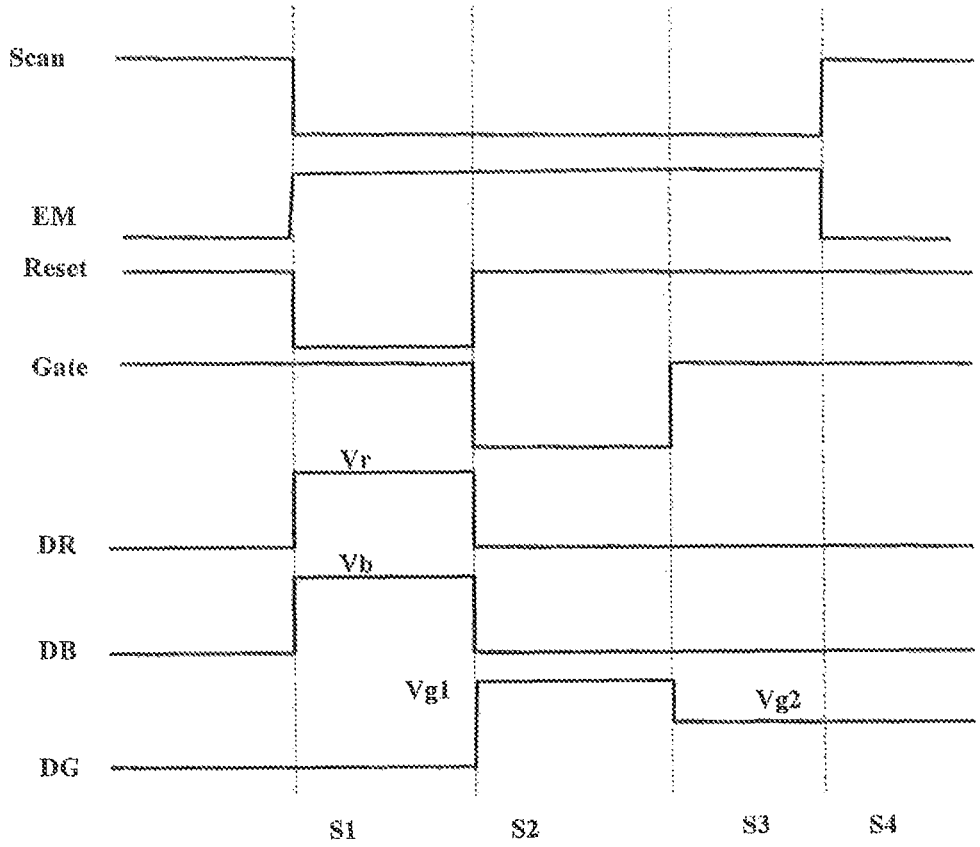
FIG. 5 illustrates a timing diagram of signals in a driving method for driving the pixel circuit illustrated in FIG. 4.

FIG. 4 illustrates a structural diagram of a pixel circuit according to the second embodiment of the present disclosure. FIG. 4 differs from FIG. 1 in that in the circuit illustrated in FIG. 4, the gate of the first switch transistor T1 is separately connected to a signal output end Scan, and the circuit illustrated in FIG. 4 does not comprise the second switch transistor T2. In this case, the timing diagram of various signals for driving the pixel circuit is shown in FIG. 5. FIG. 4 differs from FIG. 2 in that in the second phase, when a low level signal is applied to Gate, a low level signal is applied to Scan at the same time to turn on the first switch transistor T1 and a first voltage Vg1 is applied to DG to set the voltage at the end B1 to Vg1; in the third phase, a low level signal is only applied to Scan to turn on the first switch transistor T1 and turn off all other transistors, and a second voltage Vg2 is applied to DG to set the voltage at the end B1 to Vg2, in which case the voltage at the end A1 correspondingly jumps to VDD+Vth1+Vg2−Vg1; and in the fourth phase, a low level signal is only applied to EM, The current generated by the first driving transistor DT_G is controlled by using the voltage difference between Vg1 and Vg2, so as to control light emitting of the first electroluminescent element L1 for display.

The pixel circuit according to the second embodiment of the present disclosure differs from the pixel circuit according to the first embodiment of the present disclosure in that in the first embodiment, the voltage at the end B1 is changed by arranging a second switch transistor T2 after the compensation phase (the second phase S2), to enable the voltage at the end A1 to jump, while in the second embodiment, the second switch transistor T2 is not arranged, and instead, a different data voltage is written to B1 through the first switch transistor T1 again after the compensation is completed to enable the voltage at the end A to jump.

It can be seen synthetically from the first embodiment and the second embodiment that in a specific implementation, the gates of various transistors connected to the same signal input end may also not be connected to the same signal input end, and may be separately controlled to achieve a similar effect. Further, the jumping control transistor (the second switch transistor T2) in FIG. 1 is not necessary. Correspondingly, in a case that various transistors are separately controlled, the channel types of the various transistors may not be completely the same.

Third Embodiment

Figure 6:
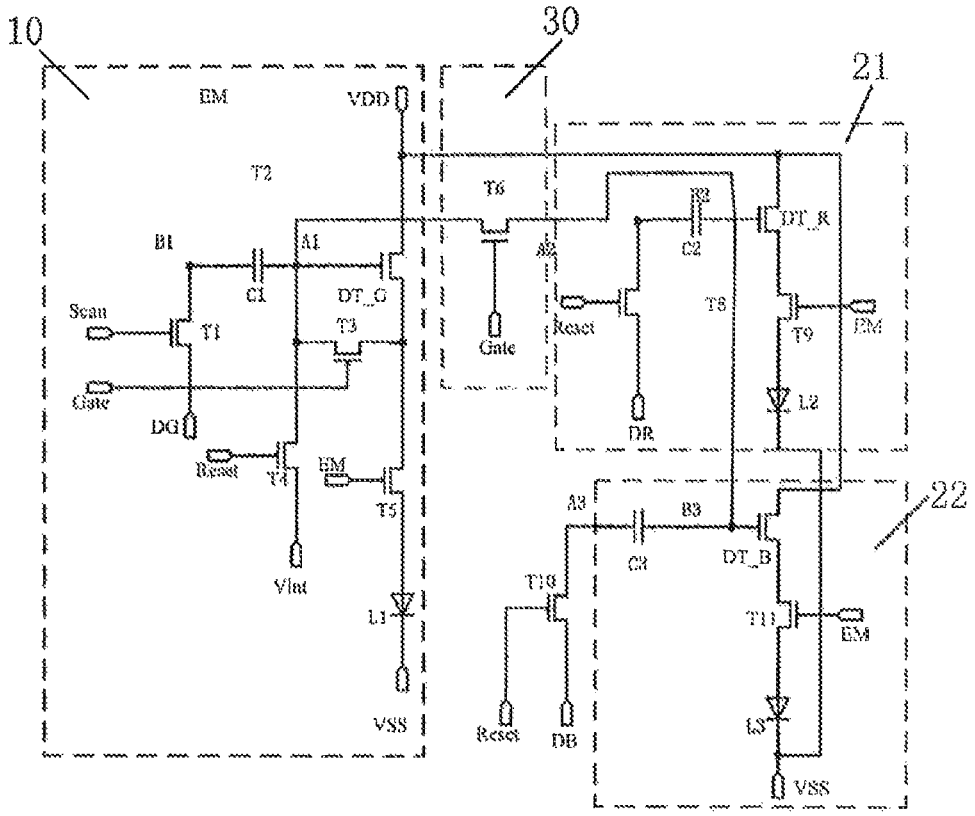
FIG. 6 illustrates a structural diagram of a pixel circuit according to a third embodiment of the present disclosure.
Figure 7:
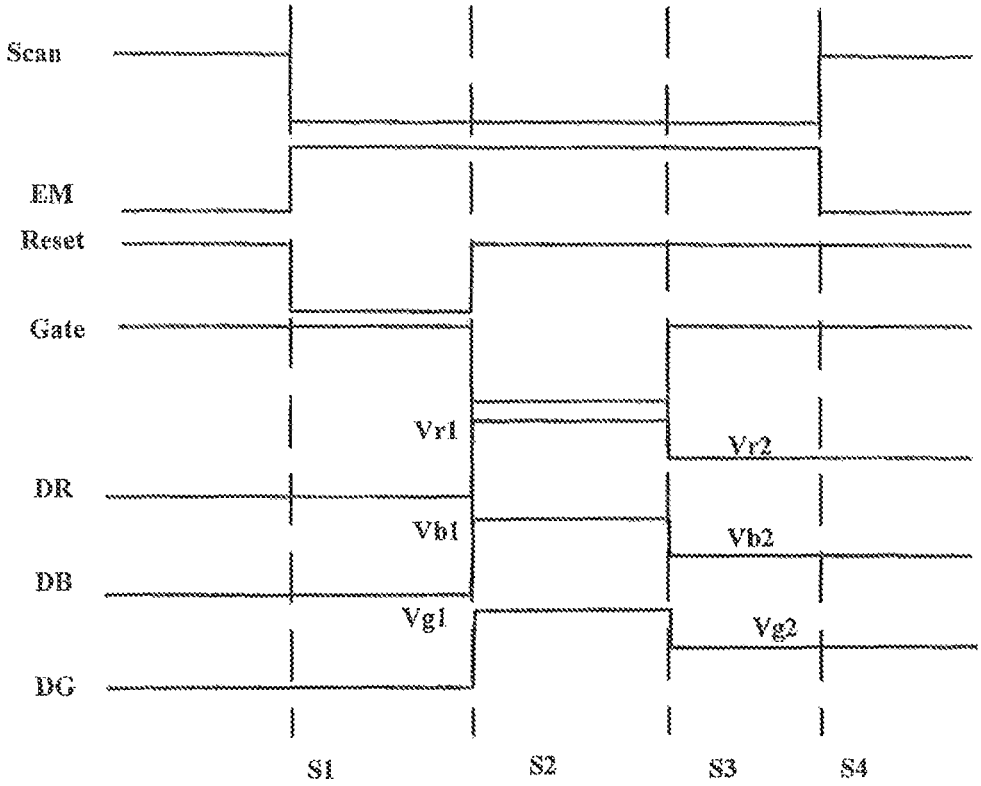
FIG. 7 illustrates a timing diagram of signals in a driving method for driving the pixel circuit illustrated in FIG. 6.

A structural diagram of a pixel circuit according to the third embodiment of the present disclosure is shown in FIG. 6. The pixel circuit in FIG. 6 differs from the pixel driving circuit illustrated in FIG. 4 in that the end A1 of the first capacitor C1 in FIG. 6 is connected to the end B2 of the second capacitor and the end B3 of the third capacitor C3 through the sixth switch transistor T6. In this case, the drain of the eighth switch transistor T8 is connected to the end A2 of the second capacitor C2, and the drain of the tenth switch transistor T10 is connected to the end A of the third capacitor C3. At this time, the seventh switch transistor T7 is not arranged, and a timing sequence of signals in the driving method for the pixel circuit may be shown in FIG. 7. The driving method in FIG. 7 differs from the driving method illustrated in FIG. 5 in that in the second phase illustrated in FIG. 5 that the voltage at the end A2 of the second capacitor C2 and the voltage at the end A3 of the third capacitor C3 are compensated to reach VDD+Vth1, according to the timing diagram of signals illustrated in FIG. 7, first voltages Vr1 and Vb1 are applied to DR and DB respectively, to set the voltage at the end A2 to Vr1 and set the voltage at the end A3 to Vb1; in the third phase illustrated in FIG. 5, second voltages Vr2 and Vb2 are applied to DR and DB respectively, to set the voltage at the end A2 to Vr2 and set the voltage at the end A3 to Vb2, and correspondingly, the voltage at the end B2 jumps to VDD+Vth1+Vr2−Vr1 and the voltage at the end B3 jumps to VDD+Vth1+Vb2−Vb1; and in the fourth phase, light emitting is implemented for display in the manner of the fourth phase in FIG. 5. In this case, control of light emitting may also be achieved by using the voltage difference between the first voltage and the second voltage.

According to the technical solution of the third embodiment, an end (A1) of the capacitor C1 in the first sub-pixel circuit which is connected to a gate of a corresponding driving transistor is connected to ends (B2 and B3) of capacitors (C2 and C3) in the second sub-pixel circuit which are connected to gates of driving transistors through a compensation control transistor. In a specific implementation, the end A1 of the capacitor C1 in the first sub-pixel circuit which is connected to a corresponding driving transistor may also be connected to ends (A2 and A3) of the capacitors (C2 and C3) in the second sub-pixel circuit which are not connected to corresponding driving transistors through a compensation control transistor. Corresponding technical solutions also fall into the protection scope of the present disclosure, and in practical applications, it is not necessary to reset the control transistors.

Fourth Embodiment

Figure 8:
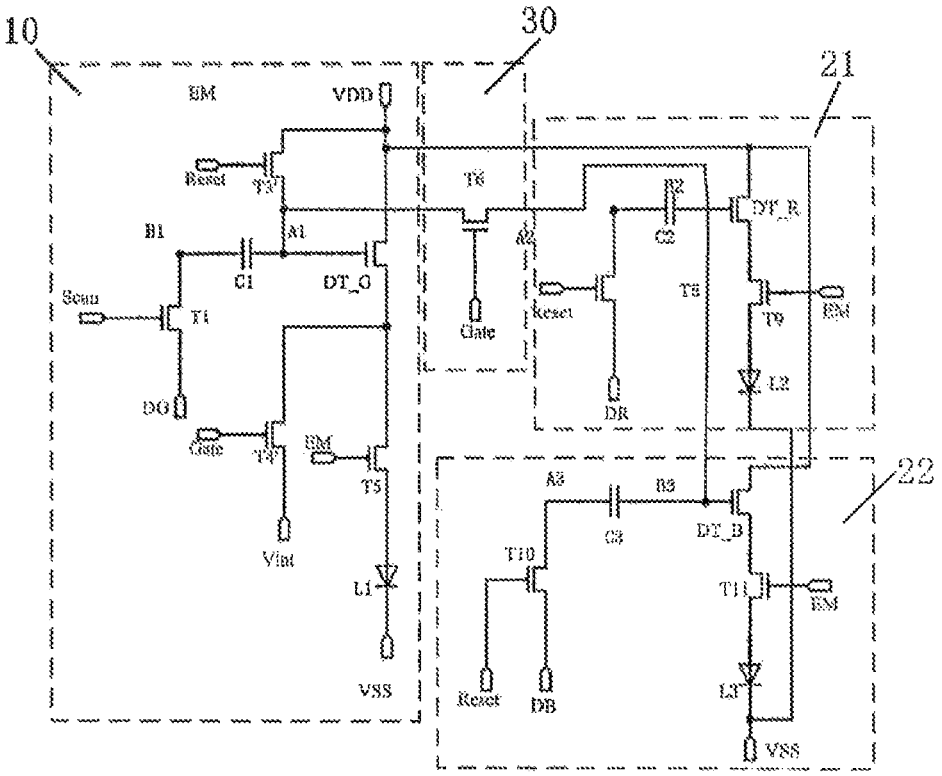
FIG. 8 illustrates a structural diagram of a pixel circuit according to a fourth embodiment of the present disclosure.

A structural diagram of a pixel circuit according to the fourth embodiment of the present disclosure is shown in FIG. 8. The structure of the pixel circuit in FIG. 8 differs from the structure of the pixel circuit in FIG. 6 in that the second driving transistor DT_R, the first driving transistor DT_G, and the third driving transistor DT_B illustrated in FIG. 8 are N-channel transistors, and compared with FIG. 6, the first sub-pixel circuit does not comprise the fourth switch transistor T4, and the third switch transistor T3 is not arranged between a source and a gate of an output end of the first driving transistor DT_G, a P-channel switch transistor T3' is arranged between a drain and the gate of the first driving transistor DT_G, the source of the first driving transistor DT_G is further connected to one of a source and a drain of a P-channel switch transistor T4', and the other of the source and the drain of the switch transistor T4' is connected to the ground.

At the same time, the pixel circuit according to the fourth embodiment of the present disclosure may comprise four control signal input ends, i.e., Reset, Gate, EM and Scan. A gate of the third switch transistor T3' is connected to Reset, gates of the switch transistor T4' and the sixth switch transistor T6 are connected to Gate, gates of the first switch transistor T1, the eighth switch transistor T8, and the tenth switch transistor T10 are connected to Scan, and gates of the fifth switch transistor T5, the ninth switch transistor T9 and the eleventh switch transistor T11 are connected to EM.

Figure 9:
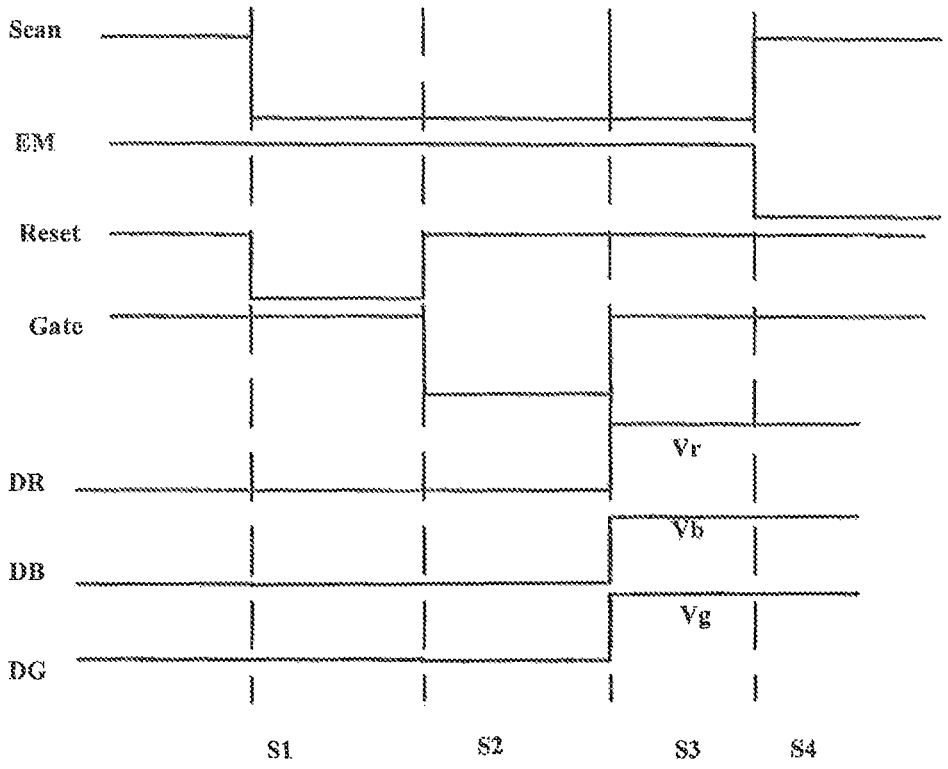
FIG. 9 illustrates a timing diagram of signals in a driving method for driving the pixel circuit illustrated in FIG. 8.

FIG. 9 illustrates a timing diagram of signals in the driving method according to the fourth embodiment of the present disclosure.

As shown in FIG. 9, in the first phase S1, a low level signal is applied to the end Reset to turn on the gate of the third switch transistor T3'. In this case, the Vdd charges the end A1 through the switch transistor T3', and thereafter, the voltage at the end A1 changes to VDD. Therefore, the switch transistor T3' acts as a charging control transistor. A low level is applied to a Scan signal line, to turn on the first switch transistor T1, the eighth switch transistor T8 and the ninth switch transistor T9, to reset the voltages at the end B1 of the first capacitor C1, the end A2 of the second capacitor C2, and the end A3 of the third capacitor C3.

In the second phase S2, a low level signal is applied to the Gate line, to turn on the sixth switch transistor T6 and the switch transistor T4', the end A1 of the first capacitor C1 starts to discharge along the first driving transistor DT_G and the switch transistor T4', and at the same time, due to turn-on of T6, voltages at the end A1 of the first capacitor C1, the end B2 of the second capacitor C2 and the end B3 of the third capacitor C3 are set to be the same. After the discharging process is completed, the voltages at the end A1 of the first capacitor C1, the end B2 of the second capacitor C2, and the end B3 of the third capacitor C3 are the threshold voltage Vth1 of the first driving transistor DT_G. In this phase, the threshold voltage Vth1 of DT_G is compensated to each capacitor, and the transistor T4' acts as a compensation control transistor. At the same time, a low level signal is applied to the Scan voltage line, to continuously turn on the first transistor t1, the eighth transistor T8 and the tenth transistor T10, and a low level signal is continuously applied to the ends DG, DR and DB. After the discharging process is completed, the voltage difference on the first capacitor C1, the second capacitor C2 and the third capacitor C3 are Vth1.

In the third phase S3, a low level signal is applied to Scan, to turn on the first switch transistor T1, the eighth switch transistor T8, and the ninth switch transistor T9, and corresponding data voltages (assuming that the data voltages are Vg, Vr and Vb) are applied to the ends DG, DR and DB respectively, to turn off all other TFTs at the same time. In this case, a voltage jump phenomenon occurs at the end A1 of the first capacitor C1, the end B2 of the second capacitor C2, and the end B3 of the third capacitor C3, and thereafter the voltages are Vg+Vth1, Vr+Vth1 and Vb+Vth1 respectively, so as to achieve the purpose of threshold compensation.

In the fourth phase S4, a low level signal is applied to EM to turn on the fifth switch transistor T5, the ninth switch transistor T9 and the eleventh switch transistor T11, and control to turn off all other control transistors, so that the first electroluminescent element L1, the second electroluminescent element L2 and the third electroluminescent element L3 emit light. As the threshold compensation is completed, the light emitting of the first electroluminescent element L1, the second electroluminescent element L2 and the third electroluminescent element L3 are not influenced by the threshold voltages of the corresponding driving transistors.

Thus, in a specific implementation, the driving transistors may be of an N channel type or a P channel type. On the premise that the technical solutions of the present disclosure can be achieved, the corresponding technical solutions fall into the protection scope of the present disclosure.

Further, it should be noted that in the above various embodiments, an end of the capacitor C1 in the first sub-pixel circuit which is connected to a gate of a driving transistor is connected to an end of the capacitor C2 in the second sub-pixel circuit through the sixth transistor T6. However, in some variations of the circuit, the end of the capacitor C1 may be directly or indirectly connected to a source of the driving transistor, and may be connected to the capacitor in the second sub-pixel circuit (specifically, an end of the capacitor which is connected to the source of the corresponding driving transistor) through the sixth transistor T6. The corresponding solutions can also solve the technical problem to be solved by the present disclosure, and correspondingly also fall into the protection scope of the present disclosure. At the same time, in some sub-pixel circuits, the light emitting control transistors are also not necessary, and will not be enumerated there.

The pixel driving circuit according to the embodiments of the present disclosure comprises multiple sub-pixel circuits, one of which is arranged with a threshold compensation module, and shares a voltage compensated by the threshold compensation module with other sub-pixel circuits through a compensation sharing circuit. In practical applications, aging degrees of pixel circuits which are close to each other are generally close, and as a result, a threshold voltage compensated by a threshold compensation module of a sub-pixel circuit may also be used for compensation of threshold voltages of other sub-pixel circuits. According to the embodiments of the present disclosure, only a threshold compensation module may be arranged for multiple pixels, so as to reduce an average area occupied by a single pixel, and is beneficial for improving the PPI of the display apparatus.

Further, it should be noted that in the above various embodiments of the present disclosure, a transistor which is used as a threshold compensation module is arranged in the first sub-pixel circuit, but in a practical display apparatus, the transistor is not necessarily completely located in a pixel region of one pixel. In practical applications, parts of the transistor may be arranged in various sub-pixels respectively, so as to avoid oversize of a single sub-pixel. The corresponding technical solutions also fall into the protection scope of the present disclosure.

The present disclosure further provides a display apparatus, comprising any pixel circuit described in any of the above embodiments.

The display apparatus here may be any product or component having a display function such as an electronic paper, a mobile phone, a tablet computer, a television, a display, a notebook computer, a digital photo frame, a navigator or the like.

The above description is merely preferable embodiments of the present disclosure. It should be noted that a number of improvements and variations can further be made by those skilled in the art without departing from the technical principle of the present disclosure, and all of these improvements and variations should also be construed as falling within the protection scope of the present disclosure.

I claim:

1. A pixel circuit, comprising:

a first sub-pixel circuit, comprising a driving transistor for generating driving current, a capacitor for pulling up a gate voltage of the driving transistor, and a threshold compensation module, wherein the threshold compensation module is connected to the capacitor in the first sub-pixel circuit to compensate for a threshold voltage of the driving transistor in the first sub-pixel circuit for the capacitor;

at least one second sub-pixel circuit, comprising a driving transistor for generating driving current and a capacitor for pulling up a gate voltage of the corresponding driving transistor; and a compensation sharing circuit having a first end connected to the capacitor of the first sub-pixel circuit and a second end connected to the capacitor of the at least one second sub-pixel circuit, wherein the compensation sharing circuit is configured to turn on the first end and the second end under the control of an input control signal, so that the threshold compensation module compensates for a threshold voltage for the capacitor of the at least one second sub-pixel circuit while compensating for the threshold voltage for the capacitor of the first sub-pixel circuit.

2. The pixel circuit according to claim 1, wherein the compensation sharing circuit comprises a sharing control transistor having one of a source and a drain connected to a first end of the capacitor in the first sub-pixel circuit, and the other connected to a first end of the capacitor in the at least one second sub-pixel circuit.

3. The pixel circuit according to claim 2, wherein each of the sub-pixel circuits comprises a writing control transistor connected between a second end of a corresponding capacitor and a data voltage input end of a respective sub-pixel circuit.

4. The pixel circuit according to claim 3, wherein each of the sub-pixel circuits comprises at least one resetting control transistor connected to a capacitor of a corresponding sub-pixel circuit to reset the capacitor of the corresponding sub-pixel circuit.

5. The pixel circuit according to claim 4, wherein a driving transistor of each sub-pixel circuit is a p-channel transistor, and each sub-pixel circuit further comprises a light-emitting control transistor connected between a drain of a corresponding driving transistor and an electroluminescent element;

the threshold compensation module comprises a compensation control transistor having one of a source and a drain connected to a drain of the driving transistor of the first sub-pixel circuit, and the other connected to the first end of the capacitor in the first sub-pixel circuit; and in the first sub-pixel circuit, a gate of the driving transistor is connected to the first end of the capacitor, in the at least one second sub-pixel circuit, a gate of the driving transistor is connected to a second end of the capacitor, and the drain of the at least one resetting control transistor is connected to a first end of a corresponding capacitor.

6. The pixel circuit according to claim 5, wherein a gate of the writing control transistor in the first sub-pixel circuit is connected to a first control signal input end of the pixel circuit; gates of the writing control transistor and the resetting control transistor in the at least one second sub-pixel circuit are connected to a second control signal input end; gates of the compensation control transistor and the sharing control transistor are connected to a third control signal input end of the pixel circuit; gates of various light-emitting control transistors are connected to a fourth control signal input end; and various transistors of which gates are connected to the same input end have the same channel type.

7. The pixel circuit according to claim 6, wherein the first sub-pixel circuit further comprises a jumping control transistor connected between the source of the driving transistor of the first sub-pixel circuit and the second end of the capacitor and has a gate connected to the fourth control signal input end; and the first control signal input end and the third control signal input end are the same input end.

8. The pixel circuit according to claim 3, wherein a driving transistor in each sub-pixel circuit is a P-channel transistor having a gate connected to a first end of a corresponding capacitor; and each sub-pixel circuit further comprises a light-emitting control transistor connected between a drain of the driving transistor and an electroluminescent element, the threshold compensation module comprises a compensation control transistor having one of a source and a drain connected to the drain of the driving transistor in the first sub-pixel circuit and the other connected to the first end of the capacitor in the first sub-pixel circuit.

9. The pixel circuit according to claim 3, wherein a driving transistor in each sub-pixel circuit is an N-channel transistor, and has a gate connected to a first end of a capacitor of a corresponding sub-pixel circuit;

each sub-pixel circuit further comprises a light-emitting control transistor connected between a drain of a corresponding driving transistor and an electroluminescent element;

the threshold compensation module further comprises a compensation control transistor having one of a source and a drain connected to the source of the driving transistor in the first sub-pixel circuit and the other connected to the ground; and the first sub-pixel circuit further comprises a charging control transistor having one of a source and a drain connected to the first end of the capacitor in the first sub-pixel circuit.

10. The pixel circuit according to claim 9, wherein the other of the source and drain of the charging control transistor is connected to a working voltage input end of the pixel circuit.

11. A method for driving the pixel circuit according to any one of claims 1-10, comprising:

applying a control signal to turn on a first end and a second end of the compensation sharing circuit when the first sub-pixel circuit implements pixel compensation.

12. A display apparatus, comprising the pixel circuit according to claim 1.

13. A display apparatus, comprising the pixel circuit according to claim 2.

14. A display apparatus, comprising the pixel circuit according to claim 3.

15. A display apparatus, comprising the pixel circuit according to claim 4.

16. A display apparatus, comprising the pixel circuit according to claim 5.

17. A display apparatus, comprising the pixel circuit according to claim 6.

18. A display apparatus, comprising the pixel circuit according to claim 7.

19. A display apparatus, comprising the pixel circuit according to claim 8.

20. A display apparatus, comprising the pixel circuit according to claim 9.

* * * * *